US005167667A

United States Patent [19]

Prigge et al.

[11] Patent Number: 5,167,667

[45] Date of Patent: Dec. 1, 1992

[54] PROCESS FOR TREATING POLISHING CLOTHS USED FOR SEMICONDUCTOR WAFERS

[75] Inventors: Helene Prigge, Chatswoof, Australia; Josef Lang, Burghausen, Fed. Rep. of Germany

[73] Assignee: Wacker-Chemitronic Gesellschaft fur Elektronik-Grundstoffe mbH, Burghausen, Fed. Rep. of Germany

[21] Appl. No.: 533,479

[22] Filed: Jun. 5, 1990

[30] Foreign Application Priority Data

Aug. 11, 1989 [DE] Fed. Rep. of Germany ..... 3926673

[51] Int. Cl.[5] ..... D06B 5/00

[52] U.S. Cl. ..... 8/137; 68/43; 134/34; 134/36

[58] Field of Search ..... 8/137, DIG. 1, 158; 68/43, 84; 252/174.15; 134/34, 36

[56] References Cited

U.S. PATENT DOCUMENTS 3,919,101 11/1975 Anstett et al. ..... 8/137
4,219,333 8/1980 Harris ..... 8/137
4,968,380 11/1990 Prigge ..... 134/26

*Primary Examiner*—Prince Willis, Jr.
*Assistant Examiner*—John F. McNally
*Attorney, Agent, or Firm*—Collard & Roe

[57] ABSTRACT

In the chemo-mechanical polishing, in particular, of semiconductor wafers, the abrasion and the geometrical quality of the wafers decreases with increasing service life of the polishing cloth. This can be prevented by treating the polishing cloth in each case after the polishing operation in a manner such that a pressure field is impressed, essentially without mechanical stress, on the polishing cloth, which pressure field causes a treatment liquid to flow through the interior of the polishing cloth and in this process the residues produced during polishing are rendered mobile and removed. A baseplate placed transversely across the polishing cloth and having a flat working surface provided with exit openings for the treatment liquid is suitable for carrying out the process. In the treatment, the treatment liquid is forced beneath the baseplate into the moving polishing cloth so that the latter is gradually traversed by the zone through which flow takes place.

6 Claims, 2 Drawing Sheets

PROCESS FOR TREATING POLISHING CLOTHS USED FOR SEMICONDUCTOR WAFERS

BACKGROUND OF THE INVENTION

The invention relates to a process and apparatus for treating polishing cloths by the action of a liquid. More particularly, it relates to such a process and apparatus used to treat cloths utilized in the polishing, in particular, of semiconductor wafers.

In the chemomechanical polishing of wafers, in particular semiconductor wafers, one or both wafer surfaces are treated with the aid of polishing cloths to which a polishing agent generally based on silicates or silicic acids is applied. The polishing cloths are stretched over a moving, usually rotating, flat polishing surface and both the abrasion and also the geometrical quality of the polished wafers obtained are found by experience to decrease with increasing duration of use of the polishing cloths. In order to counteract this effect which occurs equally for both single-sided and double-sided polishing, it is proposed in the article by E. Mendel, P. Kaplan and A. V. Patsis entitled "Pad Materials for Chemical-Mechanical Polishing" printed in *IBM Technical Report TR 22.2341,* dated Apr. 10, 1980 (and substantially made available to the public at the Spring Meeting of the Electrochemical Society in Boston, Mass. on May 10, 1979) to regenerate polishing cloths which are diminishing in performance by rinsing them with a 10% methanol/water mixture and additionally brushing them off with fiber brushes. Although such a treatment is capable of counteracting the decrease in abrasion rates they are not capable of stopping the gradual deterioration in the wafer geometry, for instance in relation to the flatness, which is observed with increasing polishing cloth service life. Variations in both parameters are equally disadvantageous for a polishing process on a production scale.

SUMMARY OF THE INVENTION

It is therefore an object of the invention to provide a process by which the polishing cloths can be prepared in the case of single-sided and double-sided polishing so that, with long polishing cloth service life and constant high abrasion rate, a high geometrical quality of the polished wafers obtained is also simultaneously guaranteed.

It is also an object of the present invention to provide suitable apparatuses for carrying out the above process.

These and related objects are achieved by a process which comprises causing a treatment liquid to flow through the polishing cloth under the action of pressure after the polishing operation, the residues produced in the interior of the polishing cloth during the polishing operation being rendered mobile and at least partially removed from said cloth by the liquid flow.

Surprisingly, it was found, in particular, that such a treatment with flow through the polishing cloth without mechanical stress leads to better results than a treatment in which the polishing cloth is also treated mechanically, for example with brushes, cleaning blades and other aids which roughen the surface.

The process is suitable in principle for use with polishing cloths which have a cavity structure which makes it possible for liquids to flow through. Such polishing cloths are known and are described, for example, in the above-mentioned paper or in EP-A-239,040 (filed 20.03.87 with priority of the U.S. application Ser. No. 843,881) and also in the patent literature cited therein and mentioned in the research report, or in EP-A-291,100. As a rule they are composed of poromers (poromeric materials), usually with a polyester or polyurethane base, in which fiber materials may also optionally be included for the purpose of reinforcement. Frequently, they are also built up sandwich-fashion from various layers and are consequently a porous multiphase system through which flow can occur.

For cost reasons alone, essentially aqueous phases are suitable as treatment liquid. In principle, even pure water, preferably demineralized or purified by reverse osmosis can be used. However, agents which are capable of chemically attacking and at least partially dissolving the residues which deposit in the polishing cloth during the polishing of the semiconductor material in question are advantageously added to the water. In the polishing of silicon wafers, for example, alkaline aqueous solutions are preferably used to treat the polishing cloth in accordance with the invention, the pH range of 10 to 12 having proved particularly satisfactory. Ammonium compounds with an alkaline reaction in aqueous solution and compounds of the alkali-metal elements, especially the hydroxides and carbonates of sodium and, in particular, of potassium, have proved satisfactory as additives. It has been found that such alkaline solutions promote the dissolution of silicate residues formed during the polishing operation in and on the polishing cloth and at the same time suppress the re-formation of silicate condensates. The phases, which generally settle in the form of a brown coating, of incompletely oxidized silicon can also as a rule be oxidized further in an alkaline medium and at least partially be rendered mobile by dissolution.

Similar effects can also be achieved in other polishing processes by additives which act chemically on the polishing residues but do not attack the polishing cloth. For polishing germanium wafers or gallium arsenide wafers, aqueous solutions which contain, for example, oxidizing components such as hypochlorite, e.g., sodium hypochlorite, as agents may be used to treat the polishing cloth.

The addition of alcohols containing at least three carbon atoms in the molecule, advantageously organosilanols, preferably trialkylsilanols and, in particular, trimethyl- or triethylsilanol, to the treatment liquid has proved advantageous, especially in treating polishing cloths used in polishing silicon wafers. It has been found that such additives counteract the condensation of silicates in a manner such that the incrustation, caused by such condensates, of the polishing cloth is prevented and even already existing incrustations can be dissolved. These alcoholic additives are at the same time effective even in low concentrations; thus, it was possible to achieve good results in the concentration range from 0.01 to 1% by weight of silanol, based on the total solution in question.

In most cases it has also proved adequate to use such additives not during every treatment step, but only periodically, for example, in every fifth to fifteenth treatment step. This applies equally to the addition of alcohols and also to compounds which chemically attack the residues but which can advantageously also be used consecutively at the same time as additives in the treatment liquid. Such a procedure is also advisable in order to keep the consumption of the often expensive additives low.

The pressure conditions under which the treatment liquid is applied to the polishing cloth play an important role. They should, on the one hand, guarantee an adequate penetration depth of the liquid into the interior of the polishing cloth and an adequate flow-through path and, on the other hand, ensure that the polishing cloth is covered on its free surface by a film of liquid so that, for example, a direct mechanical contact does not take place between the sensitive polishing cloth surface and the apparatuses or aids used to apply the treatment liquid or to skim off the liquid emerging from the polishing cloth surface. In this connection, account has to be taken essentially of effects due to the polishing cloth structure, the geometry of the exit openings through which the treatment liquid is applied to the polishing cloth, the geometry of the aids or apparatuses used for this purpose and also the pressure forces arising as a result of their inherent weight and/or additional pressure action. If there are a large number of interacting parameters, suitable pressure conditions are advantageously determined in each case in preliminary experiments and tailored to the specific case.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENTS

Figure 1:
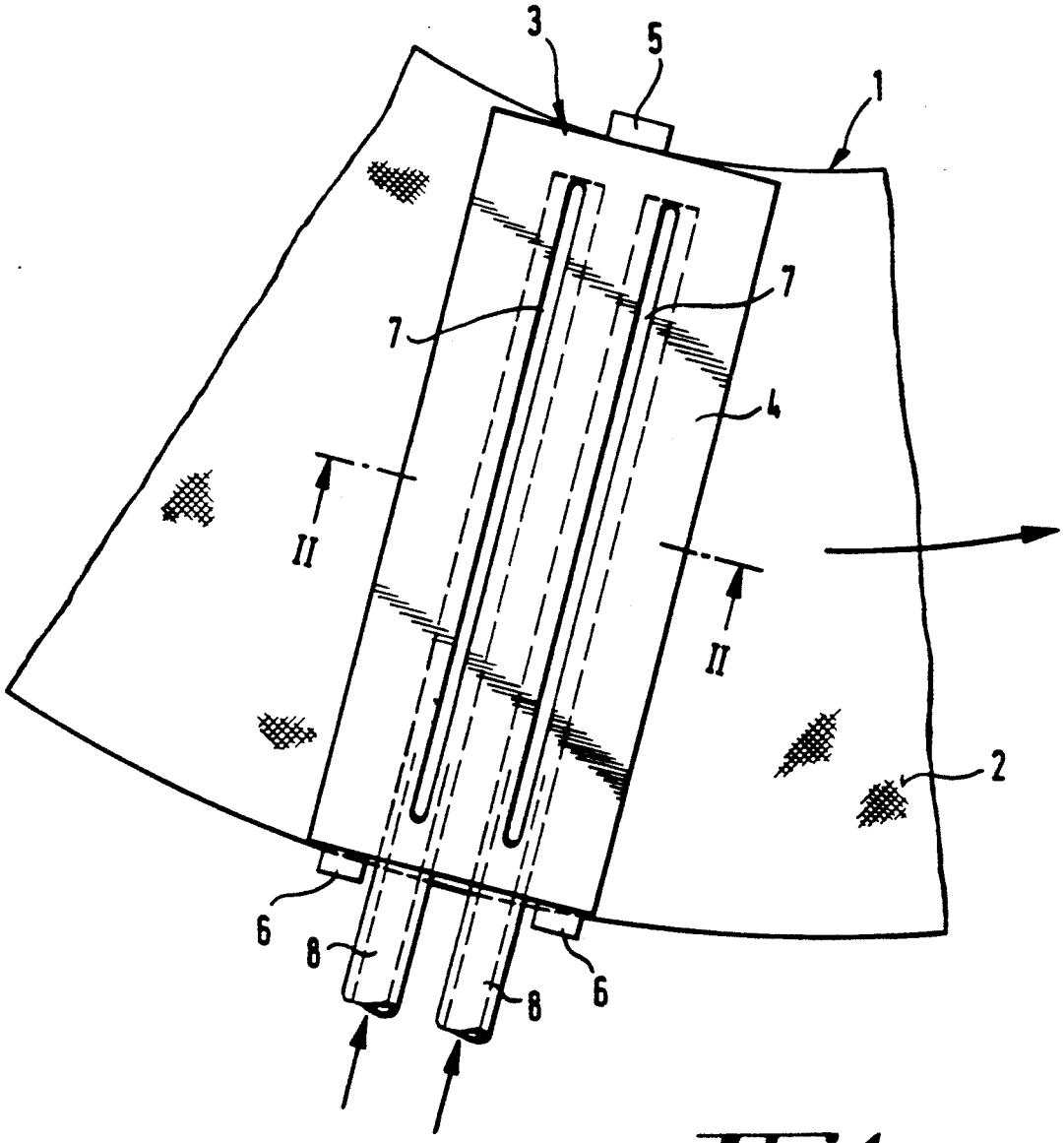
FIG. 1 is a plan view of an apparatus suitable for carrying out the process according to the invention.

Referring now in detail to the drawings, FIG. 1 shows a plan view of a portion of a polishing plate 1 of a commercial polishing machine which is covered with a polishing cloth 2 made, for example, of polyurethane. Placed on the polishing plate is an apparatus 3, shown diagrammatically, for carrying out the treatment process according to the invention. It is composed of a flat baseplate 4, made, e.g., of a sufficiently abrasion-resistant plastic such as polyvinyl chloride, polypropylene, polyurethane, polytetrafluoroethylene or fluorinated thermoplastics. Baseplate 4 could also be made of metal such as steel, aluminum or aluminum alloys or titanium which may also optionally be provided with plastic coatings, advantageously based on fluorinated thermoplastics. The baseplate may be designed as a solid or as a hollow body. In the material selection, account has, of course, to be taken of the risk of contamination; on the other hand, an adequate compressive strength and dimensional stability has also to be guaranteed in order to make possible the undisturbed build-up of the pressure field required for the treatment liquid to flow through.

When used to treat polishing cloths in single-sided polishing machines, it is adequate if only the working surface of the baseplate facing the polishing plate is flat while in double-sided polishing the baseplate advantageously has plane-parallel, flat contact or working surfaces on the top and bottom since the upper and lower polishing cloth can then be treated simultaneously. Block-shaped or bar-type baseplates have proved satisfactory, but the use of baseplates with differently designed working surfaces which, for example, expand radially outwardly are also possible.

Advantageously, inner and outer positioning aids 5 and 6 are employed to bring the baseplate into a fixed working position relative to the rotating polishing cloth and hold it in said position. They are advantageously fitted on the baseplate and can take the form, e.g., of pins, lugs or hooks.

Exit openings 7 are provided in the working surface of the baseplate facing the polishing cloth which are preferably designed as slots which span virtually the entire width of the polishing cloth. It has been found that a particularly uniform flow through the polishing cloth can be achieved with slot-type exit openings. These slot-type exit openings serve to prevent, in particular, the formation of regions with poor flow through them in which polishing residues may deposit or even become enriched in the interior of the polishing cloth. This is promoted, in addition, by the edges of the base area which extend parallel to the slots in the preferably bar-type baseplate, which edges at the same time guarantee that the part flowed through by the treatment liquid is equally long virtually over the entire width of the polishing cloth. In principle, only one such slot is needed for the treatment. However, at least two slots, beneficially extending parallel to the adjacent long edges, in each case, of the working surface, are advantageously provided since then the pressure drops in the pressure field which builds up between the polishing plate, the polishing cloth and the baseplate due to the treatment liquid supplied have less disturbing effects. This is true, in particular, for double-sided polishing. These pressure drops are due to recesses, for example, in the polishing plate such as slots, channels, gaps or openings, necessitated by apparatus design or process engineering.

In dimensioning the slots, care has to be taken, in particular, that they only come close enough to the edge of the polishing cloth for it to be possible to prevent a breakthrough of the treatment liquid in this region, which may result in a collapse of the pressure field and, ultimately, even mechanical damage to the polishing cloth. The slot width required is expediently determined in preliminary experiments; if the available pressure of the treatment liquid is known, normally, that is to say, the mains pressure of the water supply, it can be roughly estimated.

Another possibility is, for example, to allow the treatment liquid to emerge through exit openings having circular, oval or polygonal cross section and distributed, advantageously uniformly, over the bottom of the baseplate. Arrangements containing groups of slots which are offset or staggered with respect to one another, extend parallel or at an angle to the long edges of the baseplate or are annular, are conceivable, provided a uniform application to the polishing cloth is guaranteed.

In the treatment of polishing cloths used in single-sided polishing, the top of the baseplates is continuous and the exit openings are situated only on the side of the baseplate facing the polishing cloth to be treated. This is also true if it is intended, in the case of double-sided polishing arrangements, to treat the upper and the lower polishing cloth by means of separate apparatuses which only act on one side in each case. However, in this case the treatment with the aid of baseplates which have exit openings at the top and bottom and therefore make possible the simultaneous action of the treatment liquid on the upper and the lower polishing cloth is more advantageous. In this case, the necessary working pressure can also easily be adjusted over the upper polishing plate in the manner known from the actual polishing operation.

The upper and lower exit openings may under these circumstances be connected to one another and associated in each case with common pressure systems or, alternatively, be separate and assigned to pressure systems which are independent of one another.

The baseplate or the exit openings can be supplied with treatment liquid, for example, via supply pipes 8. At the same time, for the reasons already mentioned, at least two supply systems which are separate from one another are beneficially provided in order to be less sensitive to pressure variations. Expediently, the supply pipes are attached to one or more reservoirs in which the treatment liquid is provided. The necessary working pressure may be produced in various ways, for example, hydrostatically by raising the position of the reservoirs relative to the baseplate, or by pressurized gases such as, for example, compressed air acting on the liquid, or by pumping. Although, in principle, the working pressure is not subject to any limitations in the upward direction, those pressures at which the apparatus cost and also the operating and safety cost becomes disproportionately high are as a rule only used in exceptional cases. As a rule, the mains pressure provided in the standard liquid supply systems, for example water mains, is quite sufficient.

Figure 2:
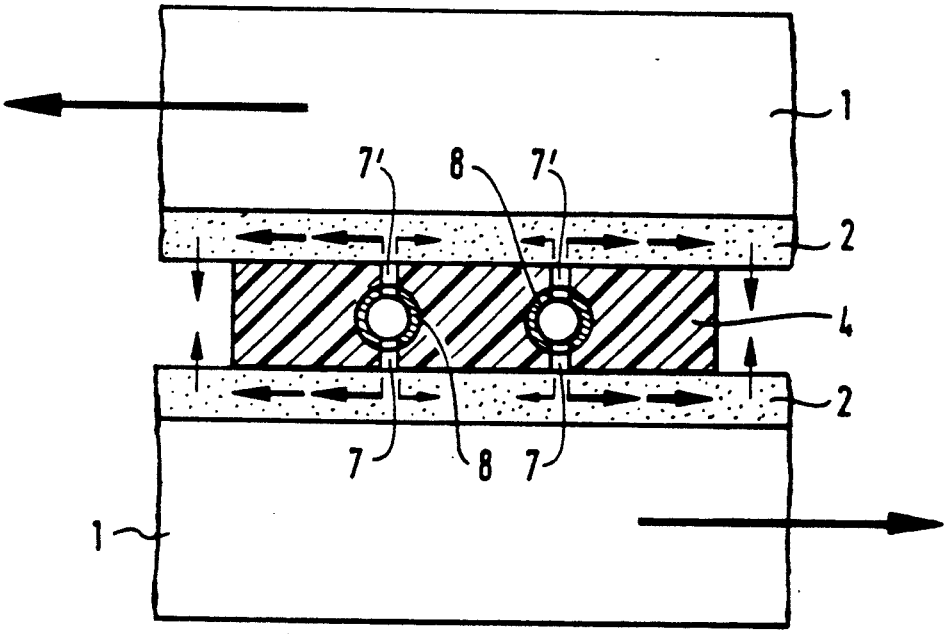
FIG. 2 is a cross-sectional view taken along line II—II of FIG. 1.

FIG. 2 shows diagrammatically in cross section, in an arrangement for double-sided polishing, the lower and upper polishing plates 1 which are covered with a polishing cloth 2 and which move, for example rotate, in opposite directions. Situated in between is the baseplate 4, out of whose upper and lower exit openings 7 and 7', which are associated with two separate supply systems, treatment liquid is forced. As indicated by the arrows, this penetrates through the surface of the polishing cloth into the interior of the two polishing cloths, flows through the latter and emerges from the polishing cloths again at the end of the baseplate. The path through which flow takes place in this case essentially corresponds to the distance between the exit openings and the edges of the baseplate, beyond which the action of the pressure field ceases, so that the treatment liquid can emerge again. Under these circumstances, it dissolves, during its path through the interior of the polishing cloth, the residues deposited there and produced in the polishing process, partly in a chemical manner and partly in a mechanical manner, entrains them in dissolved form or in the form of particles rendered mobile in the flow of liquid an finally removes them as it emerges from the interior of the polishing cloth, which interior can thereby be converted to a virtually residue-free state approaching the original state if the treatment time is sufficiently long.

In general, treatment times of 2 to 60, preferably 5 to 20, minutes have proved adequate to regenerate a polishing cloth to such an extent that it is again equivalent to an unused polishing cloth in polishing results as regards abrasion rate and wafer geometry.

The pressure field impressed on the polishing cloth in the region of the baseplate during the treatment step has its highest values at and between the two exit openings. The pressure then drops in the outward direction virtually linearly until it has reached the ambient value at the edges of the baseplate. Considered in simplified form, a trapezoidal pressure field is ultimately produced which is disturbed at the end faces. If the pressure of the treatment liquid flowing out of the exit openings exceeds the necessary limit value, the baseplate is lifted slightly relative to the lower polishing cloth and the upper polishing cloth is lifted slightly relative to the baseplate, and a thin gap, through which flow also takes place, is formed between the working surfaces and the cloths. This acts in the manner of a hydrostatic bearing so that the polishing cloth no longer acts as a transmitter of pressure forces to the polishing plate. This is true both for a polishing cloth which is stationary relative to the baseplate and also for a moving one. As already explained, this limit value is expediently determined empirically, mainly in accordance with polishing cloth type and also baseplate behavior and polishing apparatus behavior in preliminary experiments, since such factors are often difficult to estimate in advance.

During the treatment, a relative movement is established between the baseplate and the polishing cloth so that the zone which is built up in the region of the baseplate and through which flow takes place gradually traverses the polishing cloth, advantageously repeatedly. This is preferably done with a stationary baseplate and moving cloth, but in principle it can be done with a stationary cloth and moving baseplate or with both moving. Beneficially, a plurality of zones which are distributed over the polishing cloth and through which flow takes place is provided, if only to keep the treatment time short.

However, for a satisfactorily acting treatment process it is a requirement that the surface of the polishing cloth is not filled in with coatings produced in the polishing operation which consequently, make flow through the cloth no longer possible. In such cases, the surface of the polishing cloth is expediently freed as far as possible from these coatings before the actual treatment step and consequently again made capable, at least partially, of sustaining flow. In some cases this can be achieved, for example, by the action of strongly alkaline additives. Sometimes, however, polishing cloth replacement is unavoidable.

The actual treatment operation can be carried out as follows: after removing the polished wafers, the planned number of baseplates are placed in the planned working position transversely over the now free polishing cloth covering the lower polishing plate. In the case of single-sided polishing, said number advantageously corresponds to the number of pressure pistons present, by means of which a certain working pressure which counteracts the buoyancy produced by the treatment liquid can be applied during the treatment of every baseplate. In the case of double-sided polishing, at least three equally thick baseplates are expediently distributed uniformly over the lower polishing plate and then the upper polishing plate is lowered to produce the working pressure. The liquid feed is now opened and the treatment liquid flows with the pressure provided onto the surface of the polishing cloth, penetrates the interior and finally flows out of the polishing cloth again at the edge of the working surface of the baseplate, in which process the liquid present in the polishing cloth is gradually expelled, and the residues are gradually dissolved, rendered mobile and finally removed. After the gap through which flow takes place has formed between baseplate and polishing cloth, which can be detected, for example, as a result of pressure stabilization and constancy if the liquid pressure is monitored, the polishing plate or plates can be made to rotate; the rotational speed may be increased, as a rule, to values up to the polishing speed, but this is not mandatorily specified. Once the planned treatment time, usually about 5 to 20 minutes, has elapsed, the rotary movement is stopped, the liquid feed is interrupted and the pressure pistons or the upper polishing plate are/is raised. The baseplates can now be removed and a repeat polishing run can start.

The treatment process according to the invention and also the apparatuses suitable for carrying it out make it possible to achieve, in the polishing process, constantly high abrasion rates and at the same time to maintain a high geometrical precision of the polished wafers (in particular, in relation to flatness) over the entire period of use of the polishing cloth, accompanied by long polishing cloth service lives, both in the case of single-sided and double-sided polishing and also in cement/template processes. It is suitable, in particular, for use in polishing processes in which a high geometrical precision of the product is required, that is to say, primarily for semiconductor wafers made, in particular, of silicon, germanium or gallium arsenide, or wafers for magnetic memories based on, for example, gallium gadolinium garnet, but also for glass or quartz wafers for use in optical systems.

The process according to the invention is explained in more detail below with reference to an exemplary embodiment: Example:

In a commercial arrangement for double-sided polishing of silicon wafers, the upper and the lower circular polishing plates were covered with a standard poromeric polyester/polyurethane based polishing cloth (polishing cloth width approximately 50 cm). A sequence of polishing runs was carried out in this apparatus under standard polishing conditions (temperature approximately 40° C., pressure approximately 50 kPa). In these runs, batches of 25 silicon wafers each (diameter approximately 150 mm, thickness approximately 675 μm, (100) orientation) were polished for 30 minutes with a feed of a commercially available, alkaline polishing solution containing an $SiO_2$ sol.

Finally, the polishing operation was terminated, the upper polishing plate was raised and the polished wafers were removed. The wafer thickness was measured to determine the abrasion rate; it was approximately 615 μm, corresponding to an average abrasion for all the wafers of approximately 60 μm. The geometrical quality of the wafers obtained was assessed on the basis of the "TTV" value ("total thickness variation") which corresponds to the absolute amount of the difference in the maximum and minimum measured thickness values of a wafer from a multiplicity of point measurements. The measurement was carried out in a known manner with the aid of a commercial measuring instrument employing a capacitive method in which the wafer is scanned simultaneously from both sides by means of two probes of known spacing. The average value determined in this process for all the wafers was approximately 1 μm.

To treat the polishing cloth, which now exhibited a slightly brownish coloration at some points, three bar-type baseplates (length approximately 50 cm, width approximately 25 cm, thickness approximately 3 cm) made of polyvinyl chloride and of analogous design to those in the Figures were now placed on the lower polishing plate at an angle of 120° to one another and fixed in their working position transversely across the polishing cloth with the aid of outer and inner lugs. The upper and lower working surface of the baseplate was provided in each case with a pair of slots (slot width approximately 3 mm, slot spacing approximately 3 cm) in the center, which slots extended to about 2 cm from the inner and outer edge of the polishing cloth. It was possible to supply the slots situated opposite one another on the top and bottom of each baseplate separately with treatment liquid via, in each case, two supply pipes which were independent of one another.

For the standard treatment, the treatment liquid was composed of water, but for treatment after every tenth polishing run, it was composed of an aqueous solution of approximately 0.4% by weight potassium carbonate to which approximately 0.05% by weight of trimethyl silanol had additionally been added. The treatment liquid was provided in a reservoir and it was possible to apply it to the polishing cloths with a water mains pressure, available in the building, of approximately 500 kPa.

The upper polishing plate was now lowered and placed on the baseplates with a pressure of approximately 50 kPa. The feed of the treatment liquid was then raised until the liquid emerging uniformly from the polishing cloth at the edges of the baseplate revealed that a suitable pressure field had built up. It was now possible to start the upper and lower polishing plates rotating in opposite directions and the actual treatment operation, in which the residues of the polishing operation in the interior of the polishing cloth were gradually rendered mobile and removed by the liquid flowing through said cloth, began. When this operation was terminated after about 10 minutes, it was no longer possible to detect any discoloration on the polishing cloth.

The subsequent polishing run yielded the same results as the previous one in relation to abrasion and wafer geometry ("TTV") value.

Sixty polishing runs, each followed by a 10-minute polishing cloth treatment according to the invention, were carried out consecutively in the manner described here. Even after that, the abrasion was unchanged at approximately 60 μm and the "TTV" value at approximately 1 μm. No brown coating of any kind could be detected on the polishing cloth.

In a comparison experiment, a further series of polishing runs were carried out in the same arrangement with newly stretched-on and fresh polishing cloths of the same specification under the same polishing conditions. However, the intervening treatment steps were carried out in the conventional manner by placing brushes, which were then caused to rotate in opposite directions, between the polishing plates. At the same time a solution of methanol/water was fed in under these conditions via the polishing agent supply system. The treatment operation also lasted 10 minutes.

It was possible to observe a gradual decrease in the abrasion rate and a deterioration in the wafer geometry from polishing run to polishing run. After the twentieth polishing run the abrasion was only approximately 36 μm, despite regular cloth treatment, while the "TTV" value had deteriorated to approximately 2.5 μm, the thickness variation having increased, in particular, in the edge region of the wafers. At the same time a brown coating had built up at some points on the polishing cloths which could no longer be removed by the treatment.

While only one example of the present invention has been shown and described, it is obvious that many changes and modifications may be made thereunto without departing from the spirit and scope of the invention.

What is claimed is:

1. A process for treating a polymeric polishing cloth containing residues produced during the polishing operation of semiconductor wafers, comprising the steps of:

placing the polishing cloth on at least one flat polishing plate;

positioning over said polishing cloth a base plate having at least one flat working surface having two longitudinally-extending long edges which transversely span the polishing cloth, and having liquid supply means comprising at least two slot openings which are parallel to said long edges, and whose length is less than the width of the polishing cloth; and introducing through said supply means a treatment liquid onto the surface of the polishing cloth; under sufficient pressure to cover the surface with an aqueous treatment liquid, to provide an adequate penetration depth of said treatment liquid into the interior of the polishing cloth and to provide uniform flow therethrough whereby said residues are dispersed or dissolved in the treatment liquid and removed from the polishing cloth at the end of the baseplate.

2. The process as claimed in claim 1, wherein said treatment liquid comprises an aqueous alkaline solution.

3. The process as claimed in claim 1, wherein said treatment liquid contains an organosilanol.

4. The process as claimed in claim 3, wherein said organosilanol is trialkylsilanol.

5. The process as claimed in claim 1, wherein the flow through the polishing cloth takes place in zones.

6. The process according to claim 1, wherein said treatment liquid comprises an aqueous alkaline solution containing an alkali hydroxide or alkali carbonate.

* * * * *